US005168319A

United States Patent [19]

Kimura et al.

[11] Patent Number: 5,168,319

[45] Date of Patent: Dec. 1, 1992

[54] ROTARY DEVELOPING DEVICE FOR IMAGE FORMING EQUIPMENT

[75] Inventors: Noriyuki Kimura, Kawasaki; Minoru Suzuki, Yokohama, both of Japan

[73] Assignee: Ricoh Company, Ltd., Tokyo, Japan

[21] Appl. No.: 813,178

[22] Filed: Dec. 24, 1991

[30] Foreign Application Priority Data

Dec. 25, 1990 [JP] Japan ..... 2-405672
Jan. 29, 1991 [JP] Japan ..... 3-29315
Sep. 30, 1991 [JP] Japan ..... 3-250717

[51] Int. Cl.[5] ..... G03G 15/01
[52] U.S. Cl. ..... 355/326; 118/645; 355/245
[58] Field of Search ..... 355/245, 326; 118/645

[56] References Cited

U.S. PATENT DOCUMENTS 3,987,756 10/1976 Katayama et al. ..... 355/245 X
4,622,916 11/1986 Tanaka et al. ..... 118/645 X
4,792,825 12/1988 Saito et al. ..... 355/245

*Primary Examiner*—A. T. Grimley
*Assistant Examiner*—P. J. Stanzione
*Attorney, Agent, or Firm*—Oblon, Spivak, McClelland, Maier & Neustadt

[57] ABSTRACT

A rotary developing device for color image forming equipment has a plurality of developing units around a common rotary shaft and rotates the developing units about the common shaft to bring any one of them to a developing position. A drive connecting and disconnecting device in the form of a clutch is provided integrally with each developing unit and sets up and interrupts drive transmission from a drive source to only one of the developing units.

12 Claims, 15 Drawing Sheets

ROTARY DEVELOPING DEVICE FOR IMAGE FORMING EQUIPMENT

BACKGROUND OF THE INVENTION

The present invention relates to a copier, printer, facsimile apparatus or similar color or color/black-and-white electrophotoraphic image forming equipment and, more particularly, to a rotary developing device incorporated in such equipment and having a plurality of developing units around a common rotary shaft.

Conventional color image forming equipment include a full color copier which exposes an image carrier imagewise by light components of different colors, develops the resulting latent images by toners each being complementary in color to associated one of the light color components, and transfers the resulting toner images one above another to a single paper sheet. Multicolor image forming equipment is also conventional which exposes a plurality of image carriers by respective images to be reproduced in different colors, develops the resulting latent images by developers of different colors, and transfers the resulting toner images one above another to a single paper sheet. While such equipment needs a plurality of developing units, constructing the individual developing units independently of one another and arranging them around the image carrier increases the overall size of the equipment.

In light of the above, there has been developed a rotary developing device having a rotatable body or revolver located in the vicinity of an image carrier, and a plurality of developing units mounted on the outer periphery of the revolver and located at predetermined positions. The revolver is rotated to sequentially bring the developing units to a developing position, thereby developing each latent image formed on the image carrier in a particular color. In such a rotary or revolver type developing device, when any one of the developing units is brought to the developing position, a developer carrier incorporated in the developing unit has to be driven in a rotary motion. For this purpose, it is a common practice to mount a developing gear on each image carrier and drive it by a drive gear which is connected to an external drive source. However, when the developing gears are driven by respective drive gears, the structure becomes complicated and bulky. To reduce the size of this type of developing device, various drive mechanisms have been proposed in the past, e.g., Japanese Patent Laid-Open Publication Nos. 172660/1983 and 99169/1986 and Japanese Utility Mode Laid-Open Publication No. 110442/1977. The conventional drive mechanisms, however, have various problems left unsolved. Specifically, the gears are apt to hit against each other to have the teeth thereof broken or to fail to mesh accurately with each other. With the conventional mechanisms, it is impossible to set up and interrupt the meshing of the gears, as desired. In addition, the gears are likely to produce noise due to vibration.

SUMMARY OF THE INVENTION

It is, therefore, an object of the present invention to provide a rotary developing device for image forming equipment which is free from the drawbacks particular to conventional devices as discussed above.

A rotary developing device for image forming equipment of the present invention comprises a plurality of developing units each storing a powdery developer of particular color and each being rotatable about a common shaft to a developing position where the developing unit faces an image carrier for developing a latent image electrostatically formed on the image carrier, and a drive connecting and disconnecting mechanism associated with each of the developing units and integrally engageable with the developing units, the drive connecting and disconnecting mechanism setting up and interrupting drive transmission to only one of the developing units which is brought to the developing position.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 13:
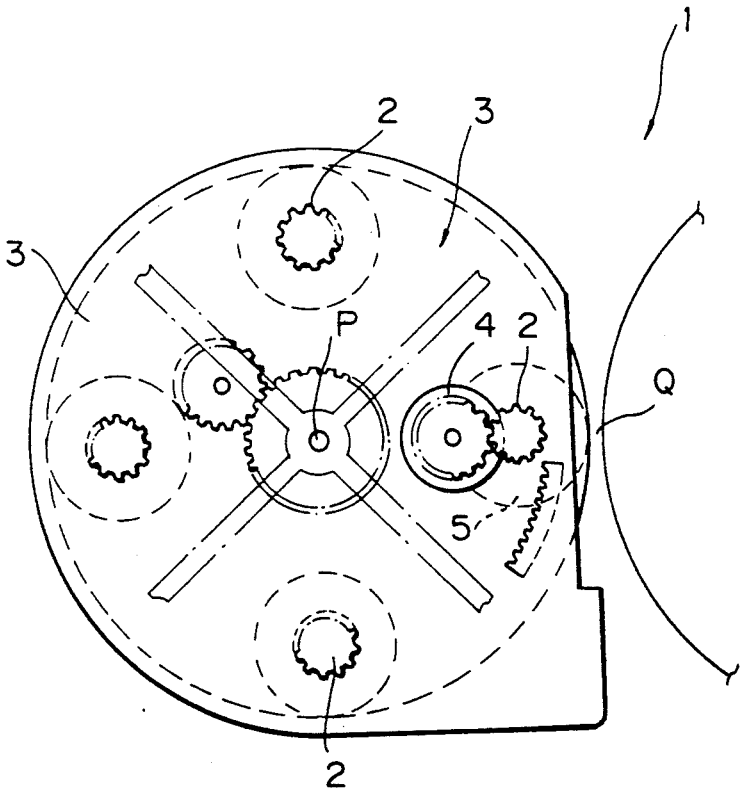
Fig. 13 PRIOR ART
FIG. 13 is a front view showing a drive mechanism included in a conventional rotary developing device.

To better understand the present invention, a brief reference will be made to a conventional rotary developing device, shown in FIG. 13. The developing device shown in the figure is assumed to have a developer carrier thereof driven by a mechanism disclosed in Japanese Patent Laid-Open Publication No. 172660/1983. As shown, the developing device, generally 1, has developing units 3 rotatable about a center P. Developing gears 2 are mounted on the respective developing units 3 around the center of rotation P while a single drive gear 4 is affixed to a member other than the developing units 3, e.g., the body of image forming equipment. As the developing units 3 are rotated about the center P until desired one of them reaches a developing position Q, the developing gear 2 affixed to a developer carrier 5 included in the developing unit 3 is brought into mesh with the drive gear 4.

The problem with the above arrangement is that when the developing gear 2 revolving round the center P begins to mesh with the drive gear 4, the teeth of the two gears 2 and 4 are apt to hit against each other. Should the developing gear 2 be continuously rotated in such a condition, the teeth thereof would be broken or the gear 2 would stop rotating and fail to accurately mesh with the gear 4. Another problem is that the drive gear 4 is constantly connected to the developing gear 2, i.e., the former cannot be selectively connected to and disconnected from the latter. Specifically, the developing gear 2 is rotated even when the developing gear 2 simply passes the developing position, e.g., when the developing device is rotated toward a home position thereof or when a particular developing unit other than the unit of interest is moved toward the developing position Q. Furthermore, when an unexpected rotating force acts on the drive gear 4 while development is not under way, the developer carrier or developing roller is rotated in the forward or reverse direction to scatter around a toner or to damage the developing device.

Figure 14:
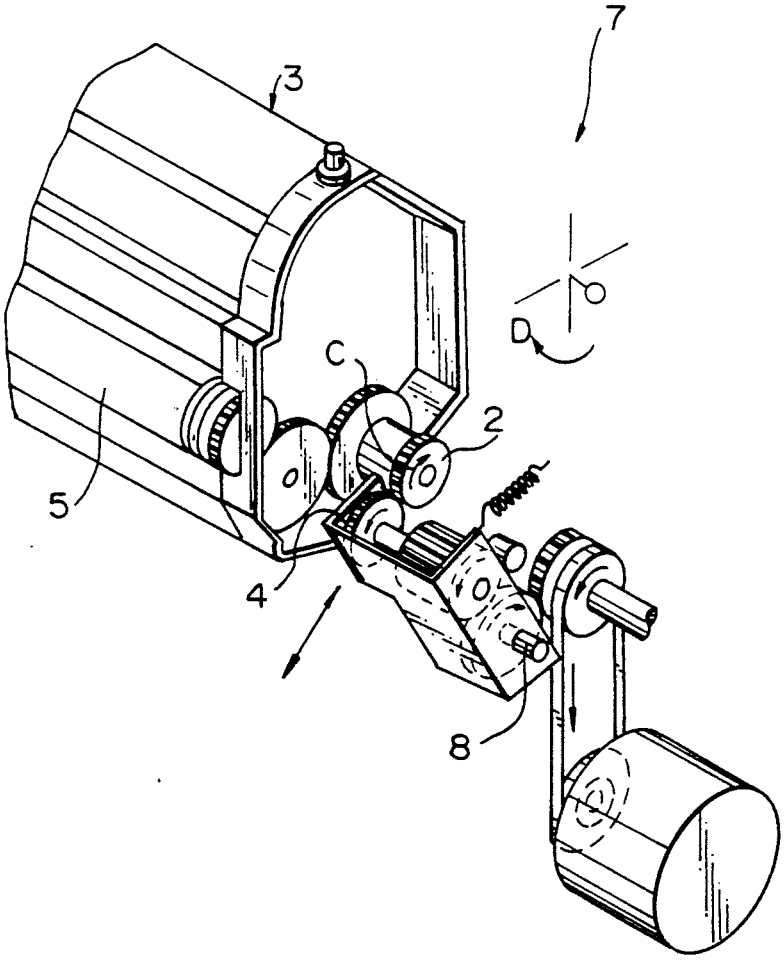
Fig. 14 PRIOR ART
FIG. 14 is a fragmentary perspective view of a drive mechanism included in another conventional rotary developing device.

FIG. 14 shows another prior art rotary developing device which is taught in Japanese Patent Laid-Open Publication No. 99169/1986 and elaborated to eliminate the above problems. In the figures, the same or similar components are designated by the same reference numerals. As shown, the developing device, generally 7, has a stationary shaft 8 located outside of the developing units 3. The drive gear 4 rotates about the shaft 8 in a pivotal motion so as not to hit against the developing gear 2. However, since the position of the drive gear 4 changes due to the rotation thereof about the shaft 8, the depth to which the gears 4 and 2 mesh changes with the magnitude of the drive torque and with a change in the drive torque, resulting in noise and, in the worst case, damage to the gears.

Japanese Utility Model Laid-Open Publication No. 110442-1977 discloses a mechanism including a stationary cam plate, and a slidable gear moved by the fixed cam plate in the axial direction of a shaft, although not shown herein. In such a configuration, the slidable gear is selectively brought out of mesh with a drive gear, so that a developing roller may be driven only at a predetermined position. However, when the slidable gear is moved along the shaft toward the drive gear at the predetermined developing position, the two gears are quite likely to hit against each other at the flanks of their teeth. This prevents the rotation of the drive gear from being accurately imparted to the slidable gear. Moreover, since the slidable gear is held between the drive gear and the stationary cam plate and, therefore, subjected to additional forces at both sides thereof, the gears and cam plate are likely to break.

Figure 1:
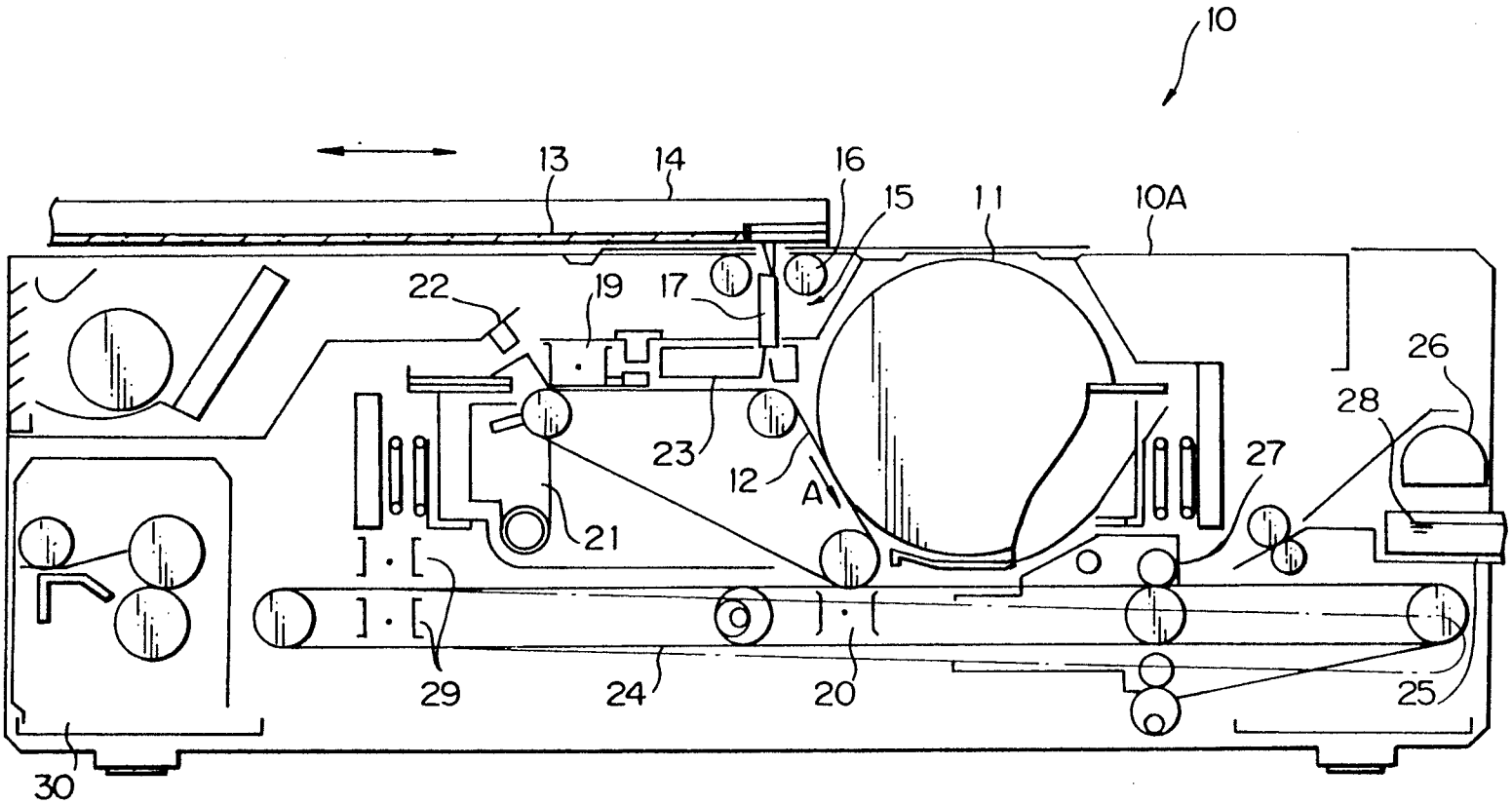
FIG. 1 shows the general construction of a full color copier to which a rotary developing device embodying the present invention is applied.

Referring to FIGS. 1-5B, a full color copier to which a rotary developing device embodying the present invention is applied is shown. As shown in FIG. 1, the copier, generally 10, has a body 10A in which a developing device 11 embodying the present invention is located at the center. The developing device, or revolver, 11 has a circular cross-section. An image carrier in the form of a photoconductive belt 12 is located in the viciniy of the revolver 11 and passed over three rollers in a triangular configuration as viewed in a section. A document 13 is laid on a platen 14 which is mounted on the top of the copier 10 and movable in the left-and-right direction, as viewed in FIG. 1. A scanning section 15 is located above the belt 12 and has a lamp 16 for illuminating the document 13 via a slit at a predetermined position, and a rod lens array 17 for focusing a reflection from the document 13 to an exposing position on the belt 12. A drive mechanism, not shown, moves the platen 14 and belt 12 in synchronism in the event of scanning the document 13. A main charger 19, the revolver 11, a transfer charger 20, a cleaning unit 21 and a discharge lamp 22 are sequentially arranged around the belt 12 in the clockwise direction. The main charger 19 uniformly charges the surface of the belt 12. A blue, a green and a red filter 23 are selectively moved into the optical path for exposure, one at a time. Latent images sequentially formed on the belt 12 via the respective filters 23 are respectively developed by a yellow, a magenta and a cyan developing unit 31 which are accommodated in the revolver 11. A transport belt 24 is disposed in an image transfer section and surrounds the transfer charger 20. A recording medium in the form of a paper sheet 28 is fed from a tray 25 to the transport belt 24 by a pick-up roller 26 and a register roller 27. As the transport belt 24 carrying the paper sheet 28 thereon moves horizontally in a reciprocating motion, toner images of three colors are transferred from the belt 12 to the paper sheet 28 one above another. After the image transfer, a discharger 29 discharges the paper sheet 28 together with the belt 24 to separate the former from the latter. A fixing section 30 fixes the toner image transferred to the paper sheet 28, thereby completing a full color copy.

Figure 2:
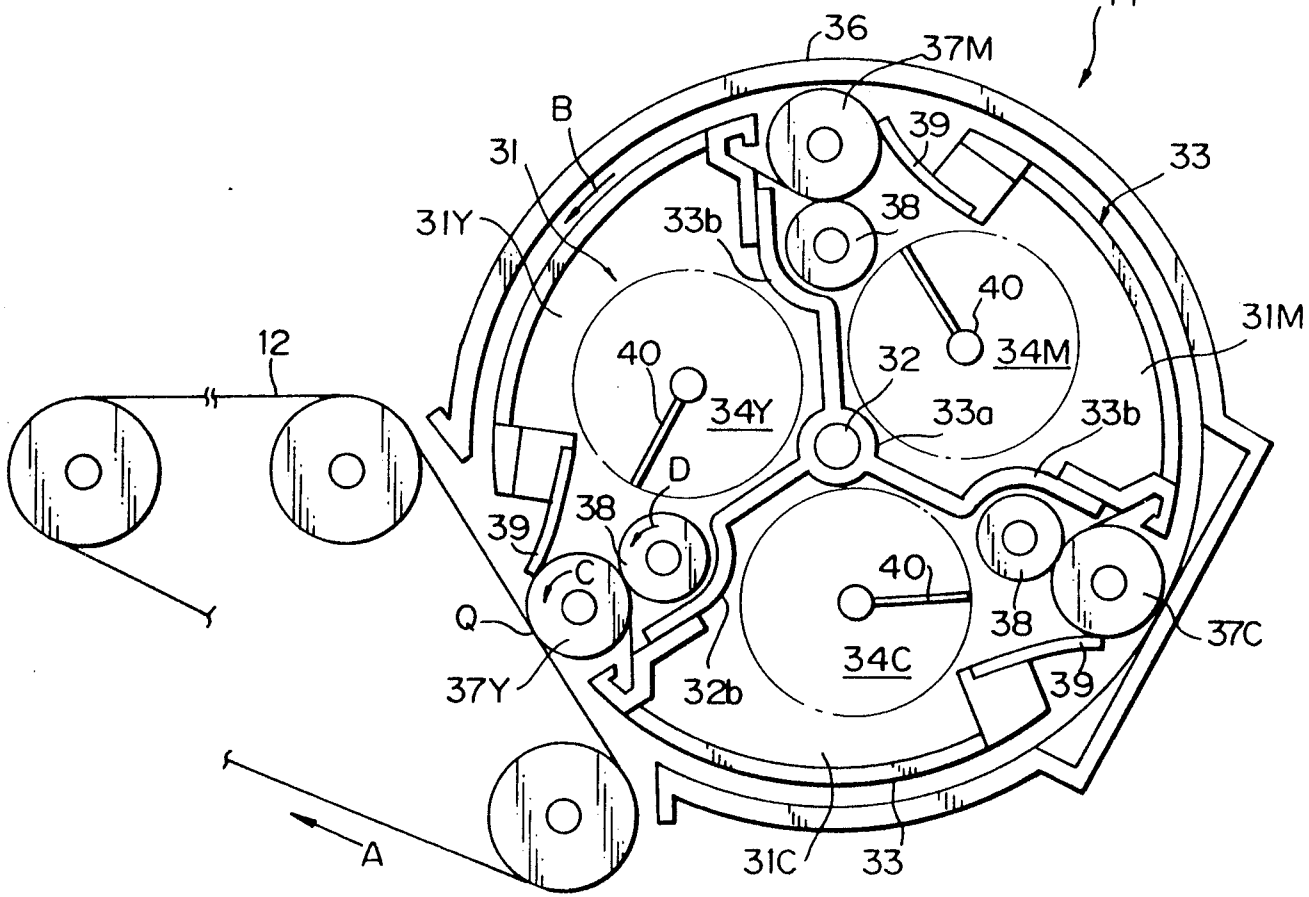
FIG. 2 is an enlarged front view of the developing device of FIG. 1 together with members adjoining it.
Figure 3:
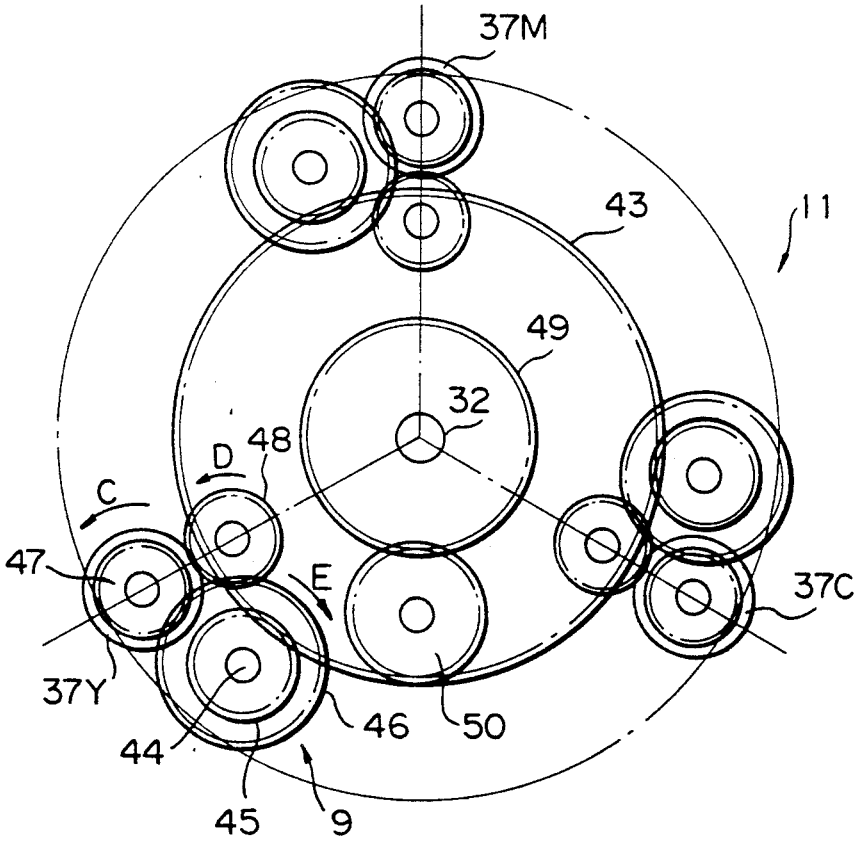
FIG. 3 is an enlarged front view of a drive mechanism shown in FIG. 2.

As shown in FIG. 2, the developing device or revolver 11 has a hollow cylindrical casing 33 which is mounted on a rotary shaft 32 and driven by a drive mechanism, not shown, to rotate in a direction B. Three partitions 33*b* extend radially from the hub 33*a* of the casing 33 to define three compartments around the shaft 32. The compartments serve as developing units 31Y, 31M and 31C, or 31 collectively. The revolver 11 is rotated about the common shaft 32 to bring desired one of the developing units 31Y, 31M and 31C to a developing position Q where the belt 12 is located. A cover 36 is associated with the casing 33 and mounted on the copier body 10A. Playing the role of a protector, the casing 36 surrounds the three developing units 31Y, 31M and 31C and has an opening which faces the belt 12. FIG. 2 shows a condition wherein the developing unit 31Y is located at the developing position Q. Cylindrical developing rollers 37Y, 37M and 37C, or 37 collectively, are respectively located at the peripheral portions of the developing units 31Y, 31M and 31C, and each serves as a developer carrier. The developing rollers 37 are each positioned such that it is partly exposed to the outside through an associated opening formed through the casing 33. A drive mechanism, not shown, drives the developing rollers 37 in a direction indicated by an arrow C in the figure. A yellow toner 34Y, a magenta toner M and a cyan toner 34C, or 34 collectively, are stored in the developing units 31Y, 31M and 31C, respectively, and each is implemented as a non-magnetic one-component powdery developer. The developing unit 31 are rotated about the shaft 32 to the developing position Q to sequentially develop latent images electrostatically formed on the belt 12. The developed images are transferred to the paper sheet 28 one above another to form a full color image.

Since the developing units 31Y, 31M and 31C are identical in configuration except for the color of the developer 34, let the following description concentrate on the developing unit 31Y by way of example. In FIG. 2, a cylindrical supply roller 38 is made of foam polyurethane or similar elastic substance and pressed against the developing roller 37Y. The supply roller 38 is also rotated by the drive mechanism which will be described in a direction indicated by an arrow D. The supply roller 38 in rotation charges the toner 34Y by friction while supplying the charged toner to the developing roller 37Y. An elastic blade 39 is made of, for example, urethane rubber and located downstream of the supply roller 38 with respect to the rotating direction of the developing roller 37Y. The blade 39 has one end thereof pressed against the developing roller 37Y to regulate the thickness of the toner deposited on the roller 37Y. An agitator 40 is selectively rotated by a drive mechanism, not shown, to agitate the toner 34Y stored in the developing unit 31Y.

The drive mechanism of the revolver 11 which is one of essential features of the present invention will be described with reference to FIGS. 3, 4, 5A and 5B. In the specific condition shown in FIGS. 3 and 4, drive connecting and disconnecting means 9 of the embodiment is shown as being associated with the developing unit 31 brought to the developing position Q. The revolver 11 has a sun gear 43 coaxial with the shaft 32 and rotatably mounted on the shaft 32 and a side panel 33*c* of the casing 33, a stationary shaft 44 associated with each developing unit 31, and an intermediate gear or idler gear 45 constantly meshing with the sun gear 43 and playing the role of a planetary gear. A clutch gear 46 is associated with the developing unit 31 and rotatably mounted on the stationary shaft 44 while facing the idler gear 45. The clutch gear 46 meshes with a gear 47 mounted on the shaft of the developing roller 37 to be rotatable integrally with the roller 37, and a gear 48 mounted on the shaft of the supply roller 38 to be rotatable integrally with the roller 38. The shafts of the rollres 37 and 38 are each journalled to the side panel 33*c* by a bearing. An input gear 49 is molded integrally with the sun gear 43 and held in mesh with a drive gear 50 which is in turn connected to a drive source, not shown, for driving the revolver 11. The drive gear 50, input gear 49, sun gear 43, idler gear 45, clutch gear 46 and gear 47 constitute a gear train for transmitting the torque of the drive source to the developing roller 37. The clutch gear 46 and gear 47 rotate integrally with each other via a clutch 55 which will be described. When the developing unit 37 is located at the developing position Q or at a position other than the position Q, such a gear train, i.e., drive mechanism remains in a predetermined meshing relation without fail. While development is under way, the drive gear 50, input gear 50, sun gear 43 and idler gear 45 are each rotated at a constant speed by the drive source.

Figure 5A:
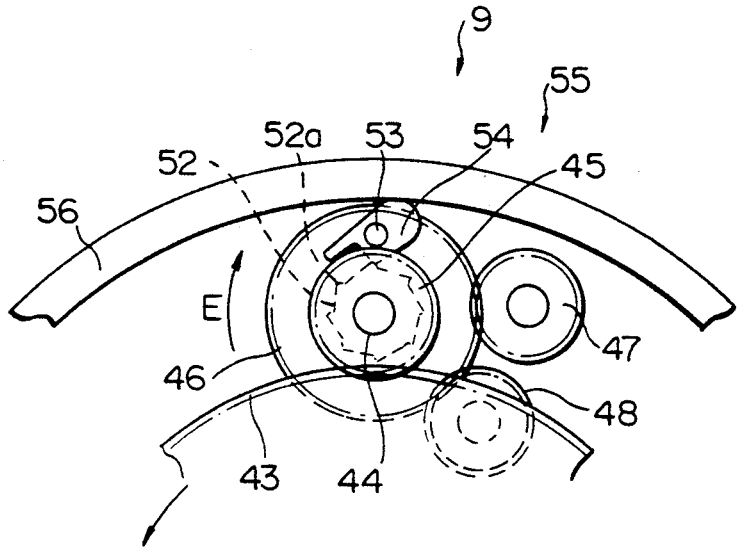
FIG. 5A is a front view showing a clutch included in the mechanism of FIG. 4 in a particular position.

As shown in FIG. 5A, a drum portion 52 extends out from the idler gear 45 in the axial direction of the stationary shaft 44 and has a plurality of (eight in the embodiment) lugs, or recesses if desired, 52*a*. The lugs 52*a* protrude radially from the idler gear 45 and are positioned at spaced locations along the circumference of the gear 45. A pin 53 is studded on the clutch gear 46 adjacent to the peripheral edge of the latter and extends toward the drum portion 52. A pawl 54 is rotatably mounted on the pin 53 and constantly biased by, for example, a torsion coil spring, not shown, as indicated by an arrow F in FIG. 5B. The drum portion 52, pin 53 and pawl 54 constitute a mechanical clutch 55. The clutch 55 is incorporated in a driveline which connects the idler gear 45 and developing roller gear 47 in each developing unit 31. The tip of the pawl 54 is engaged with any one of the lugs 52*a* of the drum portion 52. In this configuration, the rotation of the idler gear 45 is transmitted in only one direction to the clutch gear 46 and further to the developing roller gear 47 via the drum portion 52, pawl 54, and pin 53. Even when a force acts on, for example, the sun gear 43 in a direction opposite to the ordinary direction of rotation, the idler gear 45 rotates in a direction opposite to a direction E. As a result, the pawl 54 is rotated in a direction opposite to the direction F against the action of the coil spring and simply disengaged from the lug 52*a* of the idler gear 45, preventing the undesired force from reaching the developing roller gear 47.

Figure 4:
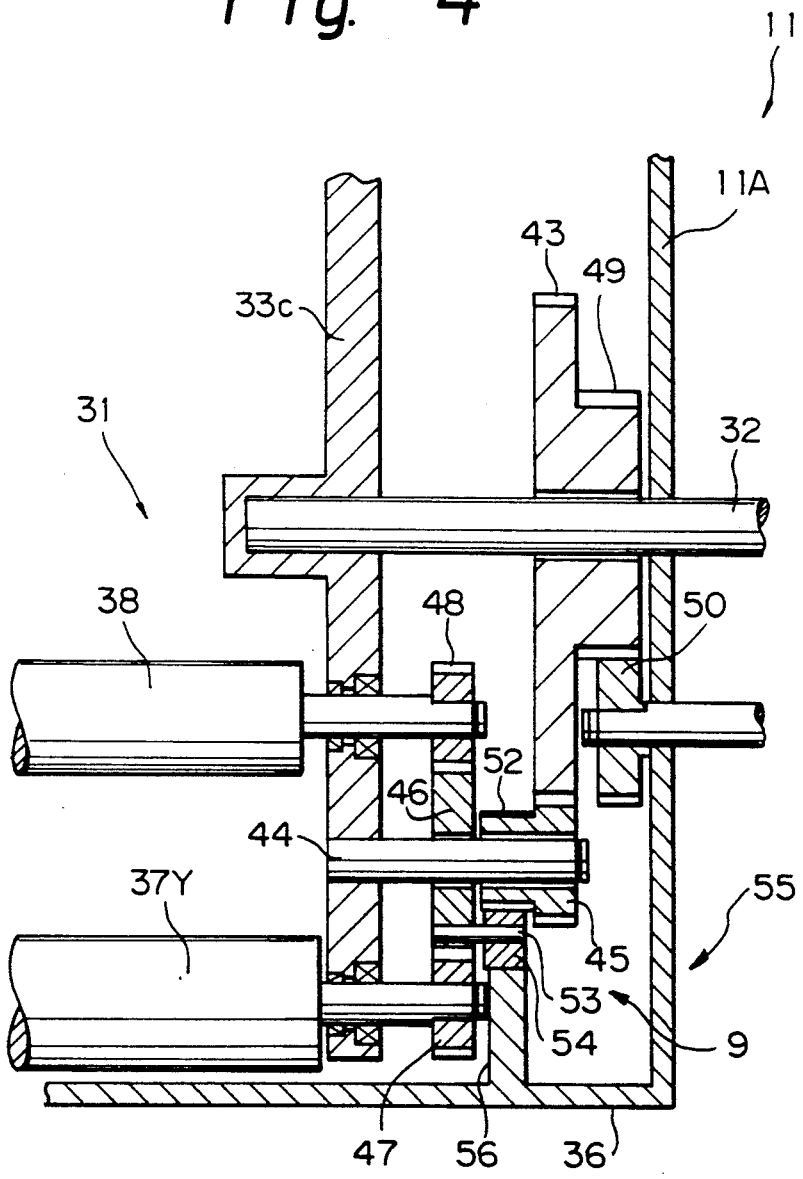
FIG. 4 is a fragmentary enlarged section of the drive mechanism shown in FIG. 3.
Figure 5B:
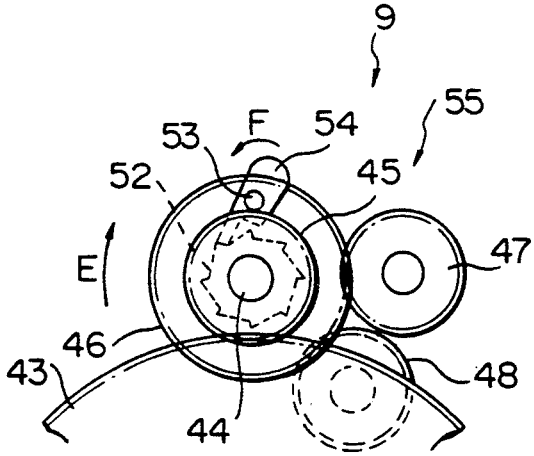
FIG. 5B is a view similar to FIG. 5A, showing the clutch in another position.

As shown in FIG. 4, a projection 56 extends on the inner surface of and substantially throughout the circumference of the cover 36 and corresponds in position to the pawl 54. The circumferential projection 56 frees the clutch 55 from restriction at and around the developing position Q. Specifically, when the developing unit 31 assumes a position other than the developing position Q, the lug 56 abuts against the rear end of the pawl 54, as shown in FIG. 5A. In this position, the pawl 54 is restricted against the force of the coil spring and has its tip released from the lug 52*a* of the drum portion 52. On the other hand, when the developing unit 31 is located at or around the developing position Q, i.e., aligned with the opening of the cover 36, the pawl 54 is released from the lug 56, as shown in FIG. 5B. As a result, the pawl 54 is rotated by the coil spring in the direction F to cause the idler gear 45 and clutch gear 46 to operatively connect to each other via the drum portion 52, pawl 54, and pin 53. In this condition, the torque from the drive source is transmitted to the developing roller 37. At least during an image forming operation, the revolver 11 rotates in one direction and at a constant speed at all times, and the developing roller 37 is driven via the clutch 55 only at and around the developing position Q. The clutch 55 and lug 56 constitute the previously mentioned drive connecting and disconnecting means 9.

The full color copier 10 having the above construction is operated as follows. Since the copier 10 is identical with conventional one regarding the general image forming procedure, the following description will concentrate on the mechanism for driving the revolver 11.

On the start of an image forming operation, the drive source is switched on to start rotating the drive gear 50, input gear 49, sun gear 43 and idler gear 45 at a constant speed. After a latent image associated with particular color has been electrostatically formed on the belt 12, the belt 12 is moved in the direction A. The developing roller 37 of one developing unit 31 corresponding in color to the latent image is moved toward the opening of the cover 36 in synchronism with the latent image. As the developing roller 37Y, for example, approaches the developing position Q, the pawl 54 is released from the projection 56 of the cover 36 and rotated to engage with the drum portion 52. As a result, the clutch 55 connects the idler gear 45 and clutch gear 46 to transmit the torque of the drive source to the clutch gear 46 via the idler gear 45. As the clutch gear 46 begins to rotate, the developing roller gear 47 and supply roller gear 48 meshing with the cutch gear 46 are rotated about their own axes. Then, the yellow toner 34Y is fed from the supply roller 38 to the developing roller 37Y while the blade 39 forms a toner layer of uniform thickness on the roller 37Y. When the developing unit 31Y reaches the developing position Q, the roller 37Y develops the latent image while rotating about its own axis. As the developing unit 31Y is further rotated to leave the developing position Q, the pawl 54 is again restricted by the projection 56. Consequently, the clutch 55 is uncoupled to interrupt the drive transmission, i.e., the rotation of the developing roller 37Y. Such a procedure is repeated with the other developing units to transfer toner images of three colors one above another to the paper sheet 28.

Every time the developing unit 31 reaches the developing position or a position therearound, the clutch 55 is released from the projection 56 to connect the developing roller 37 to the drive source. In this condition, the developing roller 37 is rotated to develop the associated latent image. As the developing unit 31 moves away from the developing position Q, the clutch 55 is again restricted by the projection 56 to interrupt the drive transmission and, therefore, the rotation of the developing roller 37. Since the start and stop of rotation of the developing roller 37 does not rely on the intermesh of gears, the revolver 11 is free from the collision of or damage to gears as well as incomplete meshing. In addition, since the drive mechanism of the revolver 11 remains in a predetermined meshing relation at all times, the revolver 11 does not cause any vibration or noise ascribable to inaccurate meshing of gears.

Moreover, the clutch 55 is released and, therefore, the developing roller 37 is driven only when the developing unit 31 is located at or around the developing position Q. Therefore, the developing roller 37 and supply rolelr 38 are not driven at positions other than the developing position Q, preventing the toner 34 from being scattered around.

Only one of the developing units 31 which is brought to the developing position Q is connected to the drive source by the clutch 55, i.e., the other two are not driven. This frees the developing units 31 from unnecessary rotations and loads and eliminates the need for an extra drive torque. Consequently, the developing units 31 undergo a minimum of aging and fails little, achieving a longer service life.

The clutch 55 is a simple mechanical clutch, and the reliable drive mechanism is mounted on the revolver 11. Hence, the size of the revolver 11 does not noticeably increase, and the drive mechanism mounted on the copier body 10A can be simplified and miniaturized. Since the drive mechanism does not include any solenoid-operated clutch, solenoid or similar electrical part, it is inexpensive and does not produce electrical noise.

Since the mechanical clutch of the embodiment sets up drive transmission in only one direction, a force tending to rotate the sun gear and other gears in the reverse direction due to, for example, an error occurred in a drive motor is prevented from reaching the developing roller 37. The reverse rotation of the roller 37 would scatter the toner or damage the developing unit.

In addition, the drive of the revolver 11 is constant while an image forming operation is under way, i.e., from the beginning to the end of printing. Therefore, it is not necessary to control the operation for replacing the developing unit 31, i.e., switching over the rotations and gears. Also, extra times for the rise and fall of the drive of the developing roller 37 are not necessary, whereby the image forming operation is sped up.

Figure 6A:
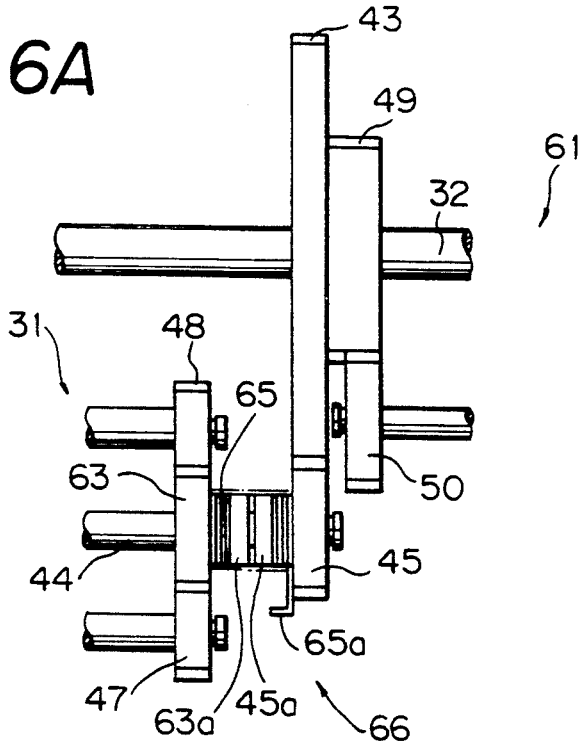
FIG. 6A is a side elevation showing an alternative embodiment of the present invention.
Figure 6B:
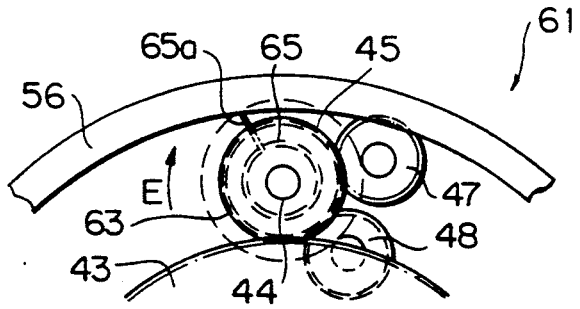
FIG. 6B is a front view of a spring clutch included in the embodiment of FIG. 6A.
Figure 6C:
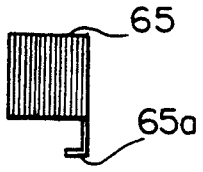
FIG. 6C is a side elevation of a coil spring included in the spring clutch.
Figure 6D:
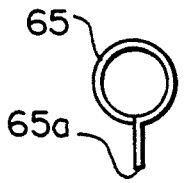
FIG. 6D is a front view of the spring clutch.

Referring to FIGS. 6A and 6B, an alternative embodiment of the present invention will be described. In the figures, the same or similar components as the components of the previous embodiment are designated by the same reference numerals, and redundant description will be avoided for simplicity. As shown, a rotary developing device or revolver 61 has the idler gear 45 meshing with the sun gear 43, and a gear 63 for driving the developing roller gear 47. These gears 45 and 47 are located to face each other and rotatably mounted on the stationary shaft 44, and each is free to rotate independently of the other. A spring clutch is interposed between the idler gear 45 and a gear 63. Specifically, the idler gear 45 and the gear have respectively cylindrical drum portions **45*a* and 63*a* which face each other. A torsion coil spring 65 is preloaded between the drum potions 63*a* and 45*a*, constituting a spring clutch 66. An arm 65*a* extends out from one end of the coil spring 65. As shown in FIG. 6B, the arm 65*a* is restricted by the projection 56 of the cover 36 when the developing unit 31 is not operating, whereby the rotation of the coil spring 65 is restricted. The restriction acts in the direction for loosening the coil spring 65, so that the spring 65 is released from the outer perephery of the idler gear 45 to cause the gear 45 to idle. Hence, when a developing operation is not effected, the rotation of the idler gear 45 is not transmitted to the gear 63, i.e., to the developing roller 37. As the casing 33 of the revolver 11 is rotated to bring the developing roller 37 to the developing position Q, the arm 65*a* of the coil spring 65 is released from the projection 56. As a result, the coil spring 65 fastens the arm 63*a* and 45*a* together. In this condition, the rotation of the idler gear 45 is imparted to the gear 63 to cause the developing roller 37 and supply roller 38** to rotate at the developing position Q.

In the embodiments described above, the projection 56 for coupling and uncoupling the clutch is formed integrally with the cover 36. Alternatively, the projection, or restricting member, 56 may be provided on the side panel of the copier body or any other suitable member. The clutch 55 may be directly mounted on the shaft of the developing roller or that of the supply roller, if desired. Further, the mechanical clutch may be implemented by a cam, friction plate or similar member in place of the pawl or the coil spring, so long as it is capable of transmitting a torque in one direction.

Figure 7A:
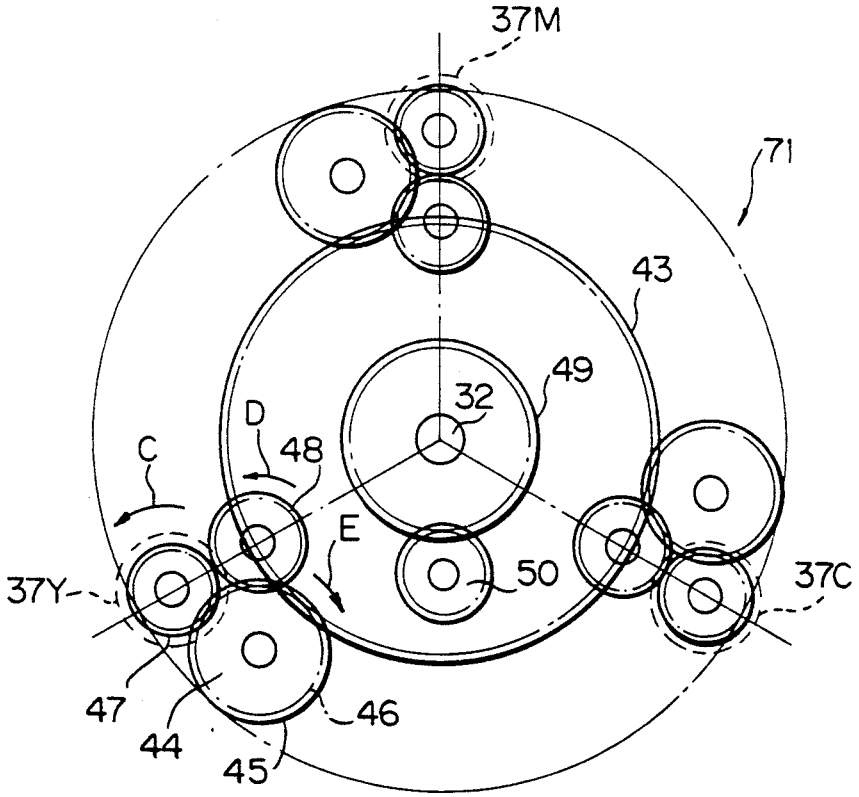
FIG. 7A is an enlarged front view showing another alternative embodiment of the present invention.
Figure 7B:
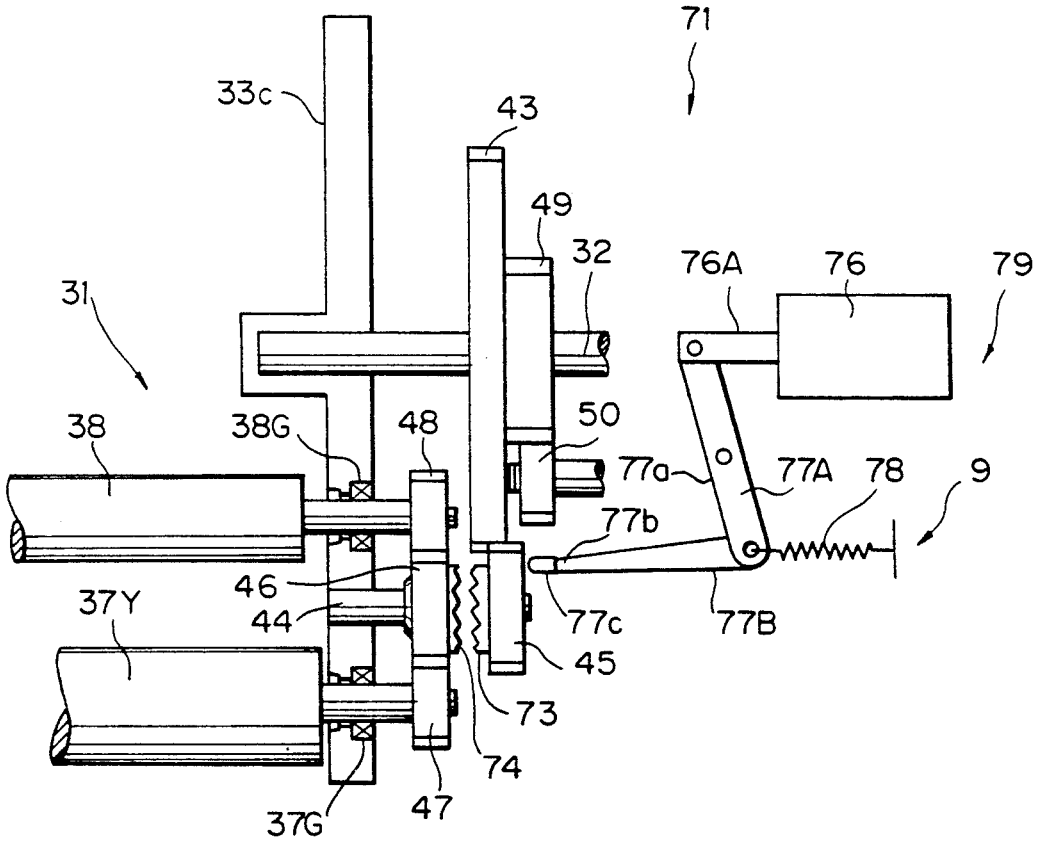
FIG. 7B is an enlarged sectional side elevation of the embodiment shown in FIG. 7A.

Referring to FIGS. 7A, 7B, 8A and 8B, another alternative embodiment of the present invention is shown. In the figures, the same or similar components as the components of the first-described embodiment are designated by the same reference numerals, and redundant description will be avoided for simplicity. As shown in FIGS. 7A and 7B, a revolver 71 has the drive connecting and disconnecting means 9 in association with each developing unit 31 and connects and disconnects the drive transmission when one of the developing units 31 is brought to the developing position Q. The sun gear 43 is mounted on the shaft 32 of the revolver 71 to be rotatable relative to the shaft 32 and the side panel 33*c* of the revolver 71. The stationary shafts 44 each being associated with respective one of the developing units 31Y, 31M and 31C are supported by the side panel 33*c*. The idler gear, or first rotatable member, 45 is mounted on each stationary shaft 44 to play the role of a planetary gear meshing with the sun gear 43. The idler gear 45 is slidable on the stationary shaft 44 over a distance which is shorter than the minimum meshing width of the idler gear 45 and sun gear 43. The clutch gear, or second rotatable member, 46 is also mounted on the stationary shaft 44 and held in mesh with the developing roller gear 47 and supply roller gear 48. The shafts of the developing roller 37 and supply roller 38 are journalled to the side panel 33*c* by bearings 37G and 38G, respectively.

Figure 8A:
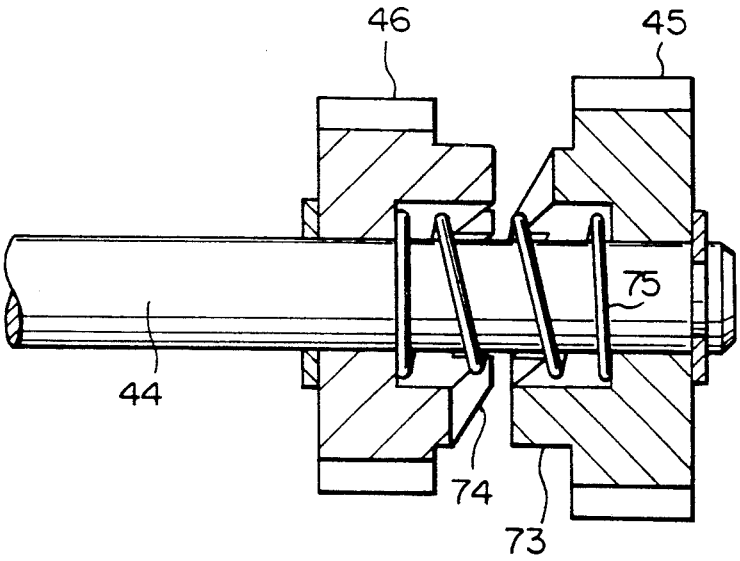
FIG. 8A is a section showing a mesh type clutch included in the embodiment shown in FIG. 7A.

The input gear 49 formed integrally with the sun gear 43 meshes with the drive gear 50. A drive source, not shown, is mounted on the copier body 10A and constantly rotates the drive gear 50 during an image forming operation. The drive gear 50 in turn rotates the input gear 49 with the result that the sun gear 43 and idler gear 45 are each rotated in a predetermined direction at a constant speed. As shown in FIG. 8A, the facing surfaces of the idler gears 45 and clutch gear 46 are respectively formed with first pawls, or first engaging portion, 73 and second pawls, or second engaging portion, 74 each being implemented as projections and recesses. The first and second pawls 73 and 74 mate with each other. The pawls 73 and 74 have a saw-tooth configuration so as to transmit a rotation in only one direction. As shown in FIG. 8A, a displacing member in the form of a coil spring 75 is mounted on the stationary shaft 44 and usually displaces the idler gear 45 away from the clutch gear 46. In this configuration, a mesh type clutch is formed between the idler gear 45 and the clutch gear 46 in combination with moving means which will be described. When the developing unit 31 is not in the developing position Q, the first and second pawls or teeth 73 and 74 provided on the idler gear 45 and clutch gear 46, respectively, are spaced apart from each other by the coil spring 75, as shown in FIG. 8A. In this condition, the rotation of the idler gear 45 is not transmitted to the clutch gear 46, so that the developing roller 37 and supply roller 38 are not rotated. In this sense, the idler gear 45, clutch gear 46 and coil spring 75 constitute a drive connecting and disconnecting mechanism.

The moving means 79 is located to face the developing unit 31 which is brought to the developing position Q. The moving means 79 moves the idler gear 45 toward and away from the clutch gear 46 to thereby cause the pawls 73 and 74 into and out of engagement. As shown in FIG. 7B, the moving means 79 is made up of a solenoid 76 having a plunger 76A, arms 77A and 77B connected to each other and capable of pushing the idler gear 45 in the axial direction, and a spring 78 anchored to the rear end of the arm 77B for constantly biasing the free end 77*b* of the arm 77*b* away from the idler gear 45. A cap member 77C is fitted on the end 77*b* of the arm 77B and has a small coefficient of friction. When the cap member 77C contacts the idler gear 45, it reduces the load acting on the idler gear 45 and protects the gear 45 and arm 77B from breakage. The idler gear 45, clutch gear 46, stationary shaft 44, coil spring 75 and moving means 79 constitute the drive connecting and disconnecting means 9.

In the above configuration when an image forming operation begins, the power source is switched on the cause the drive gear 50, input gear 49, sun gear 43 and idler gear 45 to start rotating. After a latent image associated with a particular color has been formed on the belt 12, the belt 12 starts rotating. Then, another developing unit 31 of the revolver 71 is moved toward the developing position Q in synchronism with an associated latent image formed on the belt 12.

Figure 8B:
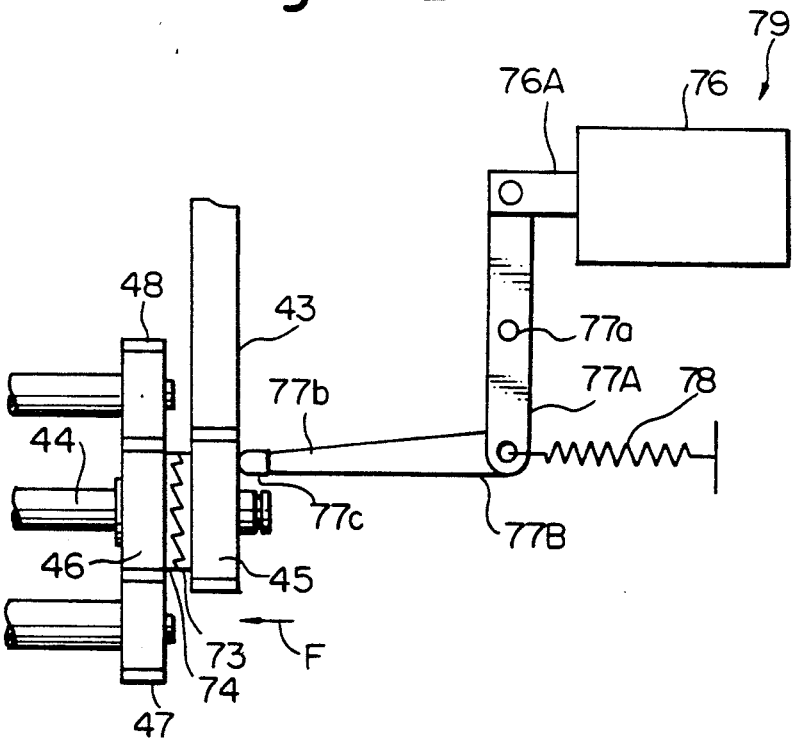
FIG. 8B is a front view of the clutch shown in FIG. 8A.

In FIG. 7B, when the developing unit 31Y, for example, reaches the developing position Q or a position therearound, the solenoid 76 is energized to pull the plunger 76A. Then, the arm 77A is rotated about a fulcrum 77*a* to urge the arm 77B toward the idler gear 45 against the action of the spring 78. As a result, the arm 77B pushes the idler gear 45 with the result that the gear 45 is slidingly moved in a direction F, FIG. 8B, against the force of the spring 75 while meshing with the sun gear 43. Consequently, the first and second pawls 73 and 74 mate with each other to thereby connect the idler gear 45 and clutch gear 46, as shown in FIG. 8B. The gears 45 and 46, therefore, are rotated in a direction E, FIG. 7A, integrally with each other. In this condition, the developing roller 37Y and supply roller 38Y are rotated to develop an associated latent image formed on the belt 12 by the yellow toner.

As stated above, in the illustrative embodiment, the idler gear 45, clutch gear 46 and coil spring 75 are mounted on the stationary shaft 44, and the moving means 79 selectively sets up and interrupts the drive transmission. Hence, the drive can be controllably transmitted with reliability by a miniature an simple construction.

Since the drive connecting and disconnecting mechanism is miniature and located in the vicinity of the developing position, the drive mechanism mounted on the copier body can be provided with a simple and miniature configuration without increasing the overall size of the developing device.

The maximum distance over which the idler gear 45 is slidable on the stationary shaft 44 is smaller than the minimum meshing width of the idler gear 45 and sun gear 43. Therefore, the first and second pawls 73 and 74 engage and disengaged from each other with the gears 45 and 43 meshing with each other. This eliminates incomplete meshing of gears, vibration, noise, and damage to gears in the event when the developing unit 31 is replaced with another.

Since the pawls 74 and 74 transmit rotation only in one direction, a rotating force which may act on the gearing, e.g., the sun gear in the reverse direction due to an error of the drive motor or an external pressure is prevented from rotating the developing roller in the reverse direction. This is also successful in eliminating the scattering of the toner and the damage to the drive-line.

Figure 9:
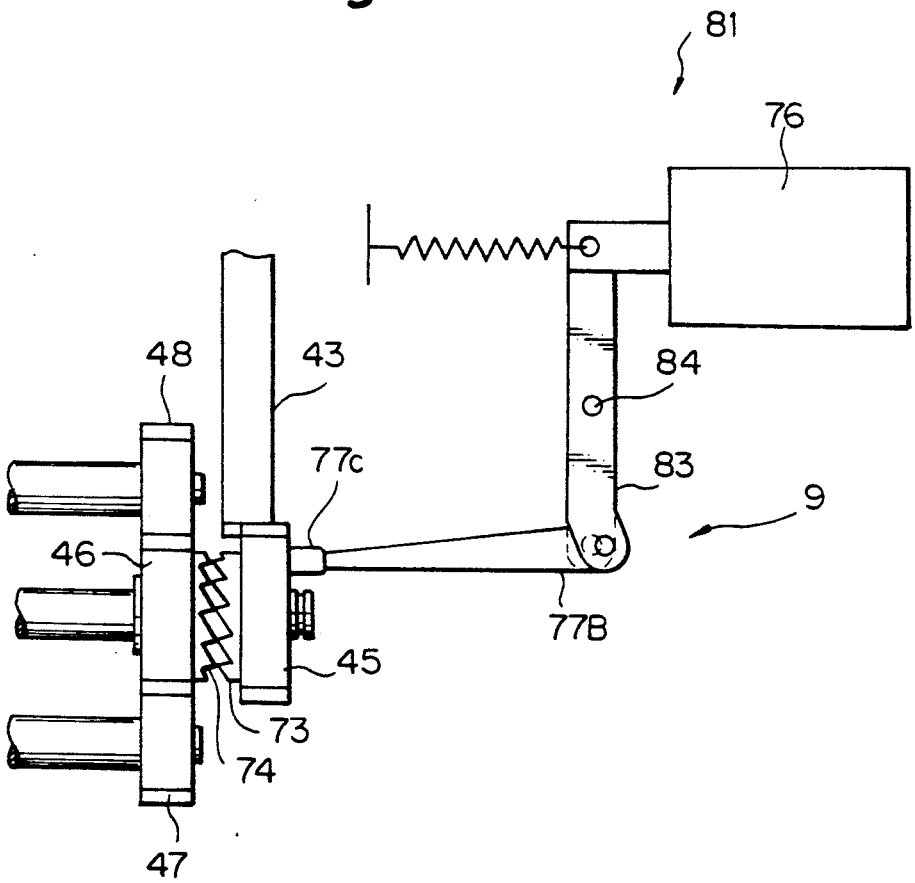
FIG. 9 is a front view showing another alternative embodiment of the present invention.

FIG. 9 shows another alternative embodiment of the present invention which is essentially similar to the embodiment of FIGS. 7A–8B. In the figures, the same or similar components are designated by the same reference numerals, and redundant description will be avoided for simplicity. Briefly, this embodiment has a torque limiter for preventing the developing roller and supply roller from rotating in the reverse direction when a reverse rotating force acts on the sun gear 43 (direction opposite to the direction E, FIG. 7A). As shown, a revolver 81 has a connecting member 83 connecting the plunger 76A of the solenoid 76 to the arm 77B. The connecting member 81 has an adequate degree of elasticity at least in the portion thereof which is closer to the arm 77B with respect to a fulcrum 84. The slants of the pawl 73 and those of the pawl 74 have an adequate angle. When the slants of the pawls 73 and 74 slide on each other due to a reverse rotating force acting on, for example, the sun gear 43 on the basis of the balance between their friction and the load, the connecting member 83 is elastically deformed to allow the idler gear 45 to move outward due to the slide of the pawls 73 and 74. This eliminates the scattering of the toneer and the damage to the developing unit which would otherwise be brought about by the reverse rotation of the developing roller and supply roller.

Figure 10A:
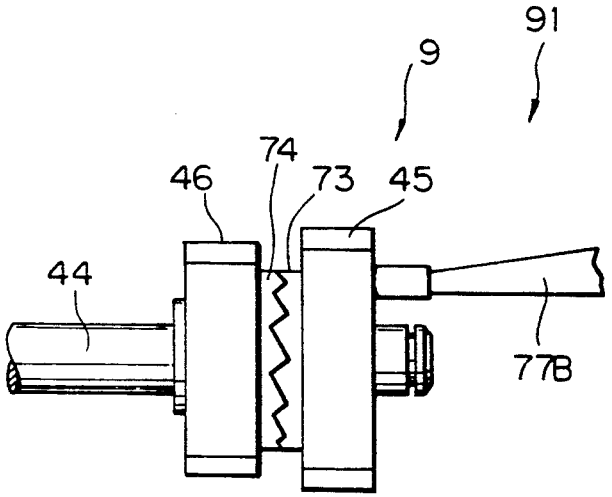
FIG. 10A is a front view showing another alternative embodiment of the present invention.
Figure 10B:
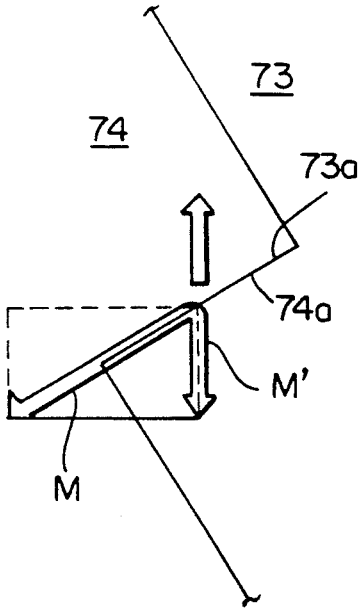
FIG. 10B is a front view demonstrating the operation of the embodiment shown in FIG. 10A.
Figure 11A:
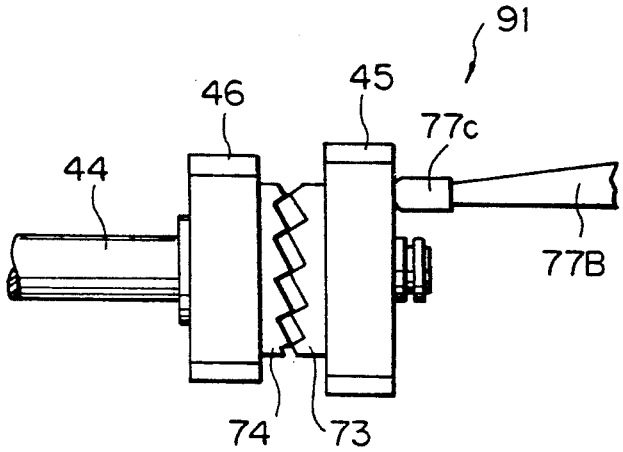
FIG. 11A is a front view showing the embodiment of FIGS. 10A and 10B in a different position.
Figure 11B:
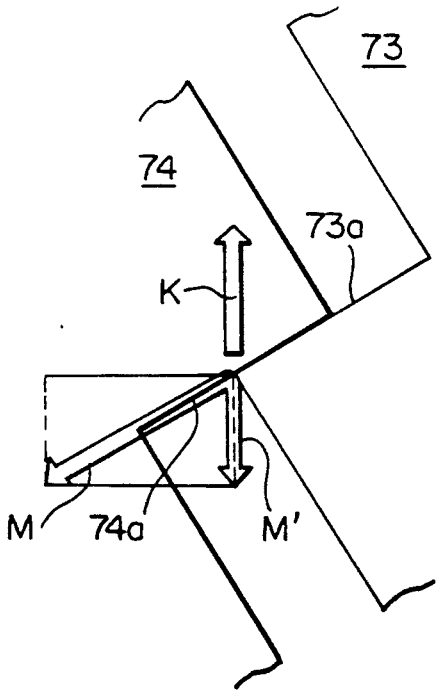
FIG. 11B is a front view indicative of the operation of the embodiment shown in FIGS. 10A and 10B.

Another alternative embodiment of the present invention is shown in FIGS. 10A, 10B, 11A and 11B. Since this embodiment is also similar to the embodiment of FIGS. 7A–8B, the same or similar components are designated by the same reference numerals. As shown, a revolver 91 is characterized in that the pawls 73 and 74 of the idler gear 45 and clutch gear 46 are each inclined from the tip to both sides with respect to the circumferential direction. The angle of each slant of the pawls 73 and 74 is selected, as follows. Assume that a driving force acts on the gears 45 and 46 with the pawls 73 and 74 mating with each other. As shown in FIG. 10B and 11B, a friction M acting between the slants **73*a* and 74*a* of the pawls 73 and 74, respectively, has a component M' parallel to the direction of rotation of the gears 73 and 74. If the component M' is greater than the load K associated with the rotation of the developing roller 37 and supply roller 38 (FIG. 10B), the pawls 73 and 74 mesh with each other to transmit the rotation of the idler gear 45 to the clutch gear 46, as shown in FIG. 10A. However, if the component M' is smaller than the load K (FIG. 11B), the slants 73*a* and 74*a* of the pawls slide on each other with the result that the idler gear 45 is spaced apart from the clutch gear 46, as shown in FIG. 11A. Then, the rotation of the idler gear 45 is not transmitted to the clutch gear 46. The pawls 73 and 74, therefore, constitute a torque limiter which causes the idler gear 45 to idle when a load exceeding a predetermined value acts on the driven system. Stated another way, only when the load is smaller than the predetermined value, the rotation of the idler gear 45 is imparted to the clutch gear 46. Specifically, assume that the load associated with the drive of the developing roller 37 and supply roller 38 has increased or such rollers have been locked up by the toner or some impurity entered the gearings 37G and 38G**, causing the load K to increase beyond the predetermined value. Then, the above-stated torque limiter interrupts the driveline to thereby prevent the motor from heating or sticking and eliminate damage to the other gears.

Figure 12:
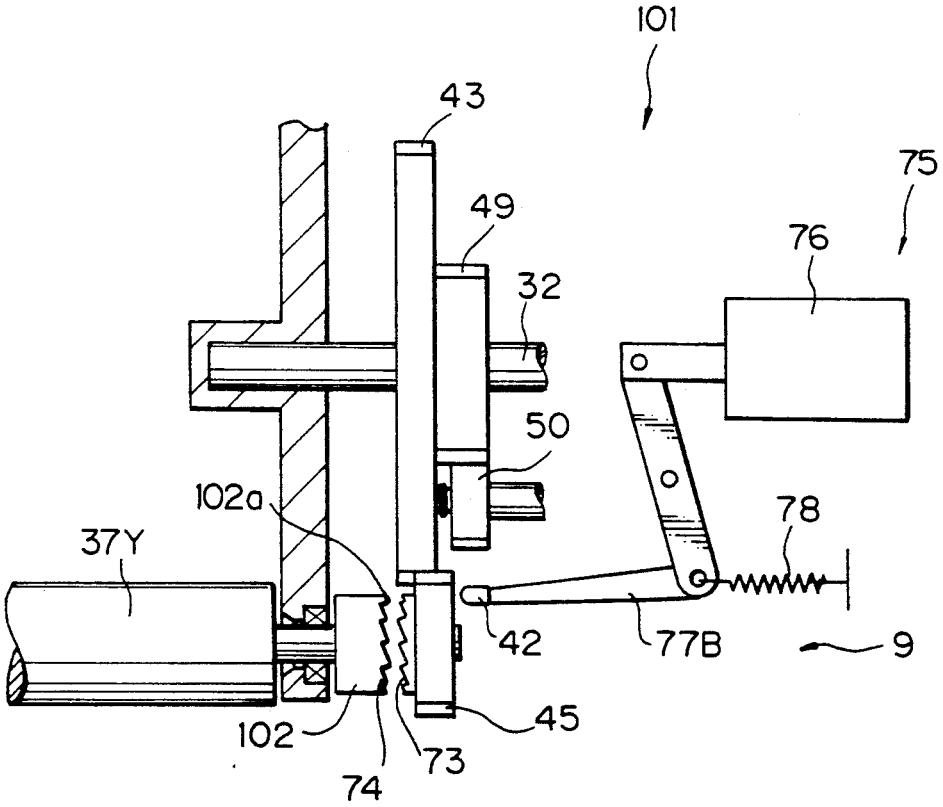
FIG. 12 is a fragmentary front view showing another alternative embodiment of present invention.

Referring to FIG. 12, another alternative embodiment of the present invention is shown which is also similar to the embodiment of FIGS. 17A–18B. As shown, a revolver 101 has a rotatable member 102 implementing the clutch gear. The rotatable member 102 does not have teeth on the periphery thereof and is mounted on the shaft of the developing roller 37. The rotatable memory 102, like the clutch gear 46, has pawls 74 which are enageable with the pawls 73 of the idler gear 45. When the arm 77B is displaced to urge the idler gear 45 toward the rotatable member 102, the pawls 73 of the idler gear 45 mate with the pawls 74 of the rotatable member 102. This directly rotates the developing roller 37 without the intermediary of a complicated gearing, simplifying the driveline. In addition, unnecessary rotation and drive torque are further reduced.

In summary, it will be seen that the present invention provides a drive mechanism which sets up and interrupts the drive transmission to a developing roller and a supply roller only at a predetermined developing position and only at the time of development. Hence, when the developing roller simply passes the developing position or a position therearound, e.g., when the developing device is rotated toward a home position or when developing units which do not neighbor one another are selectively used for development, the developing roller is free from unnecessary rotation and load. In addition, the drive mechanism does not cause the scattering of toner or the damage to the driveline.

Moreover, the drive mechanism of the present invention maintains the rotating direction of a drive motor associated with the developing units constant throughout an image forming operation, i.e., from the beginning to the end of printing. This eliminates the need for drive control in the event of the replacement of the developing unit as well as the need for an extra period of time which the motor and the drive of the developing roller would need for the rise and fall, whereby the image forming operation is sped up and the copying or printing rate is increased.

Various modifications will become possible for those skilled in the art after receiving the teachings of the present disclosure without departing from the scope thereof.

What is claimed is:

1. A rotary developing device for image forming equipment, comprising:

a plurality of developing units each storing a powdery developer of particular color and each being rotatable about a common shaft to a developing position where said developing unit faces an image carrier for developing a latent image electrostatically formed on said image carrier; and drive connecting and disconnecting means associated with each of said developing units and integrally engageable with said developing units, said drive connecting and disconnecting means setting up and interrupting drive transmission to only one of said developing units which is brought to said developing position.

2. A device as claimed in claim 1, wherein said drive connecting and disconnecting means comprises clutches associated with said respective developing units for setting up and interrupting the drive of said developing units, and a restricting member for regulating the coupling and uncoupling operations of one of said clutches when one of said developing units having said one clutch is brought to said developing position.

3. A device as claimed in claim 2, said drive connecting and disconnecting means each comprises:

a sun gear rotatably supported coaxially with said common rotary shaft;

an intermediate gear associated with said developing unit and constantly meshing with said sun gear as a planetary gear; and a developing roller gear rotatable integrally with said developer carrier which is associated with said developing unit;

said clutch being each included in a driveline connecting associated one of said developing roller gears and associated one of said intermediate gears, such that said developer carrier rotates only at and around said developing position.

4. A device as claimed in claim 2, further comprising:

a protecting member mounted at least on a body of said equipment to surround said developing units and having an opening which faces said image carrier;

said restricting member being formed integrally with said protecting member and, in said opening of said protecting member, releasing said clutch to transmit a driving force to said image carrier.

5. A device as claimed in claim 2, wherein said drive connecting and disconnecting means each comprises:

a gear train for transmitting a driving force from said drive source to said developer carrier of said developing unit;

said gear train constituting a drive mechanism which remains in a constant meshing relation when said developing unit is located at either of said developing position and a position other than said developing position, and causes said developing unit to rotate said developer carrier at and around said developing position by coupling said clutch.

6. A device as claimed in claim 2, wherein said clutch comprises a mechanical clutch which comprises a spring, a pawl, a cam or a friction plate for transmitting said driving force in only one direction.

7. A device as claimed in claim 2, wherein said driving force is exerted in one direction and at a constant speed at all times at least during an image forming operation, said clutch setting up and interrupting the transmission of said driving force to said image carrier at a predetermined position.

8. A device as claimed in claim 1, wherein said drive connecting and disconnecting means each comprises:

a first rotatable member associated with said developing unit and having a first engaging portion in the form of recesses or projections;

a second rotatable member having a second engaging portion in the form of projections or recesses engageable with said first engaging portion;

a shaft on which said first and second rotatable members are rotatably mounted with said first and second engaging portions facing each other, at last one of said first and second rotatable members being movable into and out of engagement with the other rotatable member;

a displacing member usually displacing said one rotatable member away from said other rotatable member; and moving means for moving, when any one of said developing units is brought to said developing position, said one rotatable member incorporated in said one developing unit toward said other rotatable member to cause said first and second engaging portions to mate with each other.

9. A device as claimed in claim 1, wherein said drive connecting and disconnecting means each comprises:

a sun gear rotatably mounted on either of said common rotary shaft or a shaft coaxial with said common rotary shaft;

an intermediate gear associated with said developing unit as a planetary gear coactive with said sun gear, and having a first engaging portion in the form of recesses or projections;

a rotatable body having a second engaging portion in the form of projections or recesses enageable with said first engaging portion of said intermediate gear;

a shaft parallel to said common rotary shaft and on which said intermediate gear and said rotatable body are rotatably mounted with said first and second engaging portions facing each other, at lease one of said intermediate gear and said rotary body being slidable on said shaft toward and away from the other;

a displacing member usually displacing said intermediate gear and said rotary body away from the other; and moving means for moving one of said intermediate gear and said rotary member which is slidable toward and away from each other to bring said first and second engaging portions into and out of engagement.

10. A device as claimed in claim 9, wherein one of said rotatable member, said intermediate gear and said rotatable body comprises a slidable gear slidable in mesh with another drive transmission gear, said slidable gear being slidable over a maximum distance which is shorter than the minimum meshing width of said slidable gear and said drive transmission gear.

11. A device as claimed in claim 9, wherein said first and second engaging portions are configured to drive one of said rotatable member, said intermediate gear and said rotatable body in only one direction.

12. A device as claimed in claim 9, wherein said drive connecting and disconnecting means each further comprises a torque limiter mechanism for interrupting the drive transmission to said first and second engaging portions when a load exceeding a predetermined value is generated on a downstream side of a drive transmission path to said first and second engaging portions.

* * * * *